US010786992B2

(12) United States Patent
Ishii

(10) Patent No.: US 10,786,992 B2
(45) Date of Patent: Sep. 29, 2020

(54) LIQUID EJECTION HEAD AND METHOD FOR MANUFACTURING THE SAME

(71) Applicant: CANON KABUSHIKI KAISHA, Tokyo (JP)

(72) Inventor: Miho Ishii, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 4 days.

(21) Appl. No.: 16/143,138

(22) Filed: Sep. 26, 2018

(65) Prior Publication Data

US 2019/0100006 A1 Apr. 4, 2019

(30) Foreign Application Priority Data

Oct. 3, 2017 (JP) ..... 2017-193782

(51) Int. Cl.
*B41J 2/14* (2006.01)
*B05D 5/00* (2006.01)

(52) U.S. Cl.
CPC ..... *B41J 2/1433* (2013.01); *B05D 5/00* (2013.01)

(58) Field of Classification Search
CPC ..... B41J 2/1433; B41J 2/1645; B41J 2/1606; B41J 2/1603; B05D 5/00
See application file for complete search history.

(56) References Cited

U.S. PATENT DOCUMENTS

2014/0375725 A1* 12/2014 Sameshima ..... B41J 2/1606 347/45

FOREIGN PATENT DOCUMENTS

JP 2007-518587 A 7/2007
JP 2011-206628 A 10/2011

* cited by examiner

*Primary Examiner* — Geoffrey S Mruk
(74) *Attorney, Agent, or Firm* — Canon U.S.A., Inc. IP Division

(57) ABSTRACT

A liquid ejection head includes an ejection opening member having an ejection opening therein through which a liquid is ejected, and a liquid-repellent layer over the ejection opening member. The liquid-repellent layer contains a fluorine-containing compound, metal oxide particles, and an amphiphilic compound.

17 Claims, 2 Drawing Sheets

LIQUID EJECTION HEAD AND METHOD FOR MANUFACTURING THE SAME

BACKGROUND OF THE INVENTION

Field of the Invention

The present disclosure relates to a liquid ejection head configured to eject liquid and, more specifically, to an ink jet recording head configured to eject ink onto a recording medium for recording.

Description of the Related Art

A liquid ejection head such as an ink jet recording head typically includes a substrate provided with an energy generating element capable of generating energy used for ejecting a liquid, and an ejection opening member having an ejection opening through which the liquid is ejected.

The liquid ejection from a liquid ejection head of this type is considerably affected by the surface conditions of the ejection opening member. Accordingly, the ejection opening member is provided with a liquid-repellent layer containing a fluorine-containing compound over the surface thereof to suppress the attachment of the liquid and maintain constant surface conditions. PCT Japanese Translation Patent Publication No. 2007-518587 discloses a liquid-repellent layer containing a condensate of a hydrolyzable silane compound having a fluorine-containing group and a hydrolyzable silane compound having a cationically polymerizable group.

In recent years, a variety of constituents have been added into the liquid to be ejected from the viewpoint of further improving recording quality. Unfortunately, this causes an unexpected effect of causing the liquid to tend to adhere to the liquid-repellent layer. For example, if an ink jet recording head is operated for a long time, the liquid-repellent layer is charged. This may cause the coloring material in ink to adhere to the liquid-repellent layer. The liquid-repellent layer containing a fluorine-containing compound is insulating and easy to charge. The coloring material contained in ink is often charged so as to be stably dissolved or dispersed in the ink. The reason the coloring material adheres to the liquid-repellent layer is probably due to the coloring material having a charge deposited onto the surface of the charged liquid-repellent layer. Such adhesion is more likely to occur when the coloring material is a pigment. This is because pigment dispersed in ink is generally charged and is often affected by the charge of the liquid-repellent layer. If affected, the dispersion becomes unstable, and the pigment particles aggregate easily.

Japanese Patent Laid-Open No. 2011-206628 discloses a method for eliminating static electricity from the surface of a liquid ejection head by generating ions from a static elimination electrode disposed opposite the liquid ejection head and applying the ions to the surface of the head by jetting air onto the surface.

However, the static elimination disclosed in Japanese Patent Laid-Open No. 2011-206628 requires an apparatus for generating ions and an air flow generator for jetting the ions to the ejection openings, leading to a large-scale system.

SUMMARY OF THE INVENTION

According to an aspect of the present disclosure, there is provided a liquid ejection head including an ejection opening member having an ejection opening therein through which a liquid is ejected, and a liquid-repellent layer over the ejection opening member. The liquid-repellent layer contains a fluorine-containing compound, metal oxide particles, and an amphiphilic compound.

Also, a method is provided for manufacturing a liquid ejection head including an ejection opening member having an ejection opening therein through which a liquid is ejected, and a liquid-repellent layer over the ejection opening member. The method includes forming the liquid-repellent layer by applying a solution containing a fluorine-containing compound, metal oxide particles, an amphiphilic compound, and a solvent to a form a coating film of the solution and hardening the coating.

Further features of the present disclosure will become apparent from the following description of exemplary embodiments with reference to the attached drawings.

The present disclosure provides a liquid ejection head that does not easily allow solids in liquid to adhere to the surface of the liquid-repellent layer and a method for manufacturing such a liquid ejection head.

DESCRIPTION OF THE EMBODIMENTS

Figure 1A:
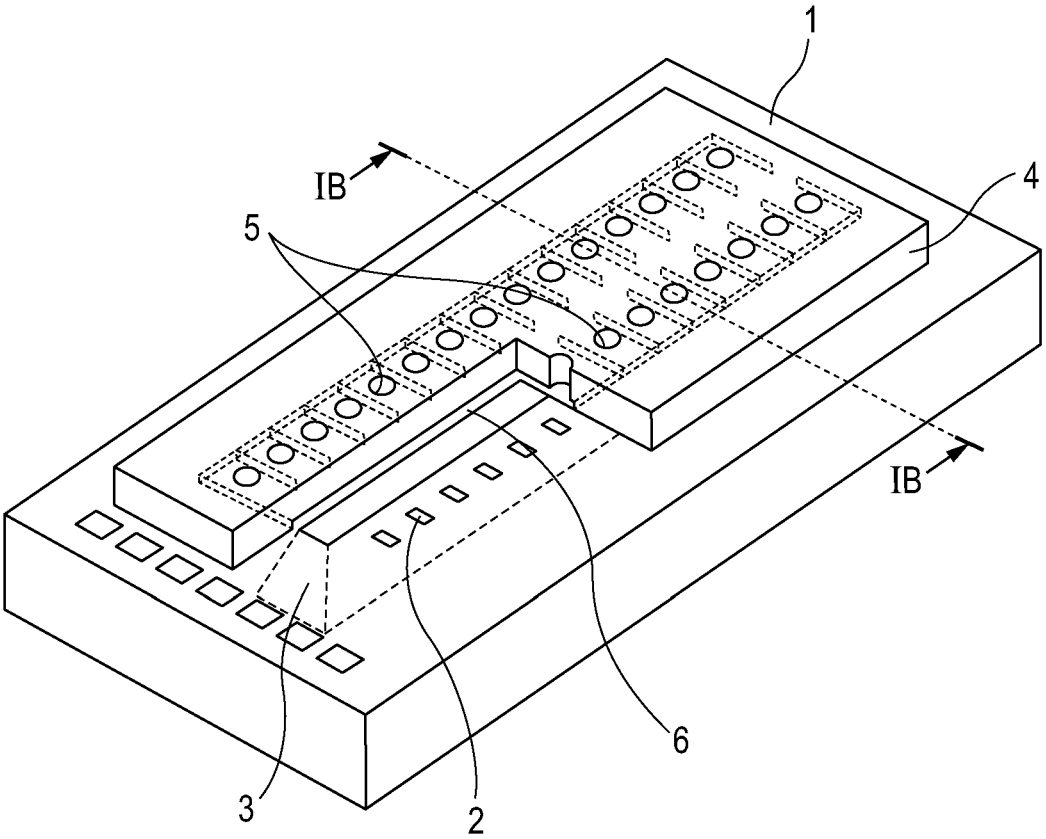
FIG. 1A is a schematic perspective view of a liquid ejection head according to an embodiment of the present disclosure.

In the liquid ejection head according to the embodiments of the present disclosure, a liquid-repellent layer containing a fluorine-containing compound, metal oxide particles, and an amphiphilic compound is disposed over the surface of an ejection opening member.

The present inventors have added an antistatic agent to the liquid-repellent layer to suppress electrostatic charge to the liquid-repellent layer as a measure against the adhesion of liquid such as an ink containing a pigment.

Exemplary antistatic agents include alkali metal salts and metal oxide particles. However, alkali metal salts may be removed from the surface of the liquid-repellent layer when ink comes into contact with the liquid-repellent layer and are thus not suitable to suppress the adhesion of ink over a long period. Metal oxide particles are not stably dispersed and are likely to aggregate in a layer such as the liquid-repellent layer that contains a fluorine-containing compound and is rather hydrophobic. Consequently, charges are localized to a portion at the surface of the liquid-repellent layer and cause the ink to adhere to the surface instead.

On the other hand, the present inventors found that metal oxide particles can be stably dispersed even in a liquid-repellent layer containing a fluorine-containing compound by adding an amphiphilic compound, thereby suppressing the adhesion of ink to the liquid-repellent layer effectively.

Exemplary embodiments of the subject matter disclosed herein will now be described with reference to the drawings.

Although the following embodiment of the liquid ejection head of the present disclosure is implemented as an ink jet recording head (hereinafter simply referred to as the recording head), many other embodiments may be made without being limited to the disclosed embodiment. For example, the liquid ejection head can be used in apparatuses such as printers, copy machines, facsimile machines including a communication system, and word processors including a printing portion, and, in addition, used in industrial recording apparatuses combined with a variety of processing devices.

The "recording medium" mentioned herein refers to a medium that allows recording thereon and may be made of a variety of materials including paper, threads or strings, fiber, cloth, leather, metal, plastics, glass, wood, and ceramics. Also, the term "recording" mentioned herein refers to forming an image or pattern having no specific meaning on a recording medium, as well as to adding visual information having meaning, such as letters, characters, figures, graphics, or diagrams, to the recording medium. Furthermore, the terms "ink" and "liquid" mentioned herein should be understood in a broad sense and refer to a liquid that is applied to a recording medium to form images, figures, patterns, or the like on the recording medium or to treat the recording medium. The treatment of the recording medium is an operation intended to increase the fixability of the ink applied onto the recording medium by solidifying or insolubilizing the coloring material in the ink, to increase recording quality or color developability, or to increase the durability of recorded images.

Recording Head

Figure 1B:
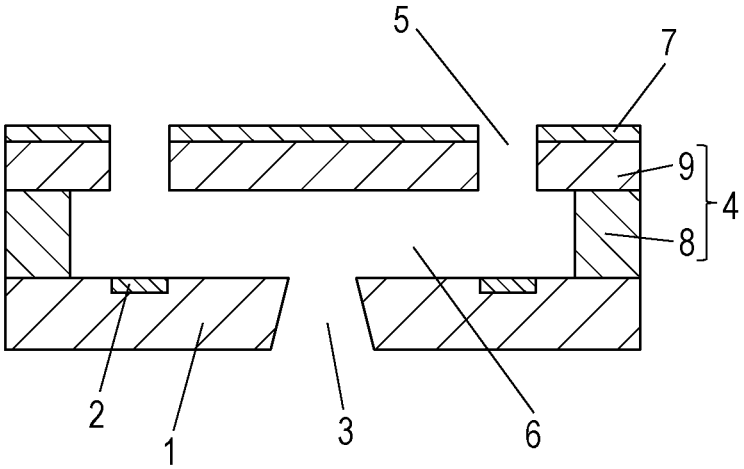
FIG. 1B is a schematic sectional view of a liquid ejection head according to an embodiment of the present disclosure, taken along line IB-IB in FIG. 1A.

FIG. 1A is a schematic view of the recording head according to an embodiment of the present disclosure, and FIG. 1B is a sectional view of the recording head viewed in section perpendicular to the substrate 1, taken along line IB-IB shown in FIG. 1A.

The recording head shown in FIG. 1A includes a substrate 1 including energy generating elements 2 configured to generate energy used for ejecting liquid. The energy generating elements 2 are arranged in two lines at regular intervals. The substrate 1 has a liquid supply port 3 formed between the two lines of the energy generating elements 2. An ejection opening member 4 is disposed on the substrate 1. The ejection opening member 4 has ejection openings 5 formed therein so as to oppose the energy generating elements 2. The ejection openings 5 may be formed in a tapered shape whose cross section, parallel to the surface of the substrate 1, gradually decreases in the direction from the substrate 1 to the ejection opening 5. The ejection opening member 4 has a side wall 8 defining discrete flow channels 6 communicating with the corresponding ejection openings and the supply port 3, and a top plate 9 in which the ejection openings 5 are formed. The side wall 8 and the top plate 9 may be integrated in one body to define the ejection opening member 4. A liquid-repellent layer 7 is disposed on the ejection opening member 4. The liquid-repellent layer 7 prevents the ink ejected through the ejection openings 5 from attaching to the surface of the recording head. The substrate 1 is not particularly limited in terms of the shape, the material, or the like provided that the substrate 1 functions as part of a member defining the flow channels 6 and as a support for the ejection opening member 4. In the present embodiment, a silicon substrate is used because of the good workability thereof.

The recording head is disposed in such a manner that the surface thereof defining the open ends of the ejection openings 5 opposes the recording medium surface subjected to recording. Next, the energy generating elements 2 apply energy to the ink delivered to the flow channels 6 through the supply port 3 to eject ink droplets through the ejection openings 5. Recording is thus performed by applying the ink onto the recording medium. The energy generating element 2 may be an electrothermal conversion element (i.e., a heater) or the like that generates thermal energy or a piezoelectric element or the like that generates mechanical energy.

The liquid-repellent layer 7 contains a fluorine-containing compound, metal oxide particles, and an amphiphilic compound, as described above. More specifically, for forming the liquid-repellent layer 7, a solution containing the fluorine-containing compound, the metal oxide particles, the amphiphilic compound, and a solvent is applied to form a coating film of the solution, and the coating film is hardened. It should be noted that the expressions "to harden" and "hardening" used herein imply that, if the solution to be hardened contains a thermosetting or photocurable compound, the coating of the solution is cured (hardened) by heating or light irradiation. In addition, if the solution does not contain a thermosetting or photocurable compound, the expressions imply that the coating film is toughened or hardened by simply drying the coating film to remove the solvent. The thermosetting or photocurable compound may the above-mentioned fluorine-containing compound or may be a resin or any other compound that may be added to the solution in addition to the fluorine-containing compound.

The constituents of the solution used for forming the liquid-repellent layer 7 will now be described in detail.

Fluorine-Containing Compound

The fluorine-containing compound is a liquid-repellent component in the liquid-repellent layer 7. A condensate of a hydrolyzable silane compound having a fluorine-containing group may be used as the fluorine-containing compound. This condensate exhibits a liquid repellency over a long period. Since this condensate can form a strong film, the resulting liquid-repellent layer can be durable, particularly, against wiping ink from the surface of the recording head.

The fluorine-containing group of the hydrolyzable silane compound having a fluorine-containing group may be a group including a perfluoroalkyl or a perfluoropolyether group from the viewpoint of liquid repellency.

The hydrolyzable silane compound having a perfluoroalkyl group may be a compound represented by the following formula (1):

$$R_f—SiX_aY_{(3-a)} \quad (1)$$

In formula (1), $R_f$ represents a nonhydrolyzable substituent having a perfluoroalkyl group, Y represents a nonhydrolyzable substituent, X represents a hydrolyzable substituent, and a represents an integer of 1 to 3.

Beneficially, a in formula (1) is 2 or 3, particularly 3. When a represents 3, a sophisticated crosslink structure (network structure) of the fluorine-containing compound traps the amphiphilic compound and the metal oxide particles, which will be described later, stably holding the antistatic component in the liquid-repellent layer 7. Thus, a high antistatic property can be maintained over a long period.

Examples of the hydrolyzable substituent represented by X in formula (1) include halogen atoms (F, Cl, Br, and I), alkoxy groups (beneficially alkoxy groups having a carbon number of 1 to 6, such as methoxy, ethoxy, n-propoxy, isopropoxy, n-butoxy, sec-butoxy, isobutoxy, and tert-butoxy), aryloxy groups (beneficially aryloxy groups having a carbon number of 6 to 10, such as phenoxy), acyloxy groups (beneficially acyloxy groups having a carbon number of 1 to 6, such as acetoxy and propynyloxy), and alkylcarbonyl groups (beneficially alkylcarbonyl groups having a carbon number of 2 to 7, such as acetyl). In an embodiment, the hydrolyzable substituent X may be an alkoxy group. In formula (1), if the number of hydrolyzable substituents X is plural, the hydrolyzable substituents X may be the same or different. Examples of the nonhydrolyzable group represented by Y in formula (1) include substituted or unsubstituted alkyl groups having a carbon number of 1 to 20 and substituted or unsubstituted phenyl groups. In an embodiment, the nonhydrolyzable group Y may be unsubstituted. In formula (1), if the number of nonhydrolyzable substituents Y is plural, the nonhydrolyzable substituents may be the same or different.

The number of fluorine atoms in the nonhydrolyzable substituent represented by $R_f$ may be in the range of 1 to 30. In some embodiments, the nonhydrolyzable substituent $R_f$ may be represented by the following formula (6): $CF_3(CF_2)_n$—Z—.

In formula (6), n represents an integer of 0 to 20, and Z represents a divalent organic group.

In an embodiment, n in formula (6) may be an integer of 3 to 15, for example, 5 to 11. Z may represent an alkylene or alkyleneoxy group having a carbon number of 10 or less, and, in some embodiments, may be selected from among the alkylene or alkyleneoxy groups having a carbon number of 6 or less, such as methylene, ethylene, propylene, butylene, methyleneoxy, ethyleneoxy, propyleneoxy, and butyleneoxy. In an embodiment, z may be an ethylene group.

Examples of the compound represented by formula (1) include $C_2F_5$—$C_2H_4$—$SiX_3$, $C_4F_9$—$C_2H_4$—$SiX_3$, $C_6H_{13}$—$C_2H_4$—$SiX_3$, $C_8F_{17}$—$C_2H_4$—$SiX_3$, $C_{10}F_{21}$—$C_2H_4$—$SiX_3$, and $C_{12}F_{25}$—$C_2H_4$—$SiX_3$. The substituent X of these compounds is a methoxy group or an ethoxy group.

Hydrolyzable silane compounds having a perfluoropolyether group have recently been used as an alternative to hydrolyzable silane compounds having a perfluoroalkyl group from the viewpoint of increasing durability and liquid repellency and reducing environmental load. The hydrolyzable silane compound having a perfluoropolyether group may be any one of the compounds represented by the following formulas (2) to (5):

$$F—R_p—A—SiX_aY_{3-a} \tag{2}$$

$$R_{3-a}X_aSi—A—R_p—A—SiX_aY_{3-a} \tag{3}$$

$$F—R_p—Q—[A(SiX_aY_{3-a})]_m—Z \tag{4}$$

$$F—R_p—Q—[A—SiX_aY_{3-a}]_n \tag{5}$$

In formulas (2) to (5), $R_p$ represents a perfluoropolyether group, A represents a linking group having a carbon number of 1 to 12, X represents a hydrolyzable substituent, Y and R each represent a nonhydrolyzable substituent, Z represents a hydrogen atom or an alkyl group, and Q represents a divalent or trivalent linking member. When Q is a divalent linking member, n=1 holds true, and when Q is a trivalent linking member, n=2 holds true. Also, a represents an integer of 1 to 3, and m represents an integer of 1 to 4.

The hydrolyzable substituent represented by X in formulas (2) to (5) is the same as that described in formula (1), and the nonhydrolyzable substituent represented by Y in formulas (2) to (5) is also the same as that described in formula (1). The alkyl group represented by Z in formulas (2) to (5) may have a carbon number in the range of 1 to 20. In an embodiment, Z may be an alkyl group having a carbon number in the range of 1 to 4, such as methyl, ethyl, or propyl. The linking member represented by Q in formulas (2) to (5) may be a carbon atom or a nitrogen atom. The linking group represented by A in formulas (2) to (5) may be an alkylene group or an alkyleneoxy group. In an embodiment, A may be an alkylene group having a carbon number in the range of 1 to 4, such as methylene, ethylene, or propylene. Beneficially, a in formulas (2) to (5) is 2 or 3, particularly 3, as in the case of a in formula (1). When a represents 3, a sophisticated crosslink structure (network structure) of the fluorine-containing compound traps the amphiphilic compound and the metal oxide particles, which will be described later, stably holding the antistatic component in the liquid-repellent layer 7. Thus, a high antistatic property can be maintained over a long period.

The perfluoropolyether group represented by $R_p$ in formulas (2) to (5) has a structure defined by a string of at least one unit including a perfluoroalkyl group and an oxygen atom. The perfluoropolyether group $R_p$ may be represented by the following formula (7):

$$—(CF_2CF_2CF_2O)_o—(CF_2CF_2O)_p—[CF(CF_3)—CF_2—O]_q—(CF_2O)_r— \tag{7}$$

In formula (7), o, p, q, and r each represent an integer of 0 or more, and at least one of them is an integer of 1 or more.

In formula (7), the structure within each pair of the parentheses is a unit, and o, p, q, and r are each the number of repetitions of the corresponding unit and are each hereinafter referred to as the number of repetitions. The total number of the repetitions in the perfluoropolyether group $R_p$ may be an integer of 1 to 30, for example, in the range of 3 to 20. While the larger the total number of the repetitions in $R_p$, the higher the liquid repellency, an excessively large number of repetitions leads to a reduced solubility in solvent. The average molecular weight (number average molecular weight) of the perfluoropolyether group $R_p$ may be in the range of 500 to 5000, for example, in the range of 500 to 2000. The compound having a perfluoropolyether group is often a mixture of compounds varying in number of the repeating units (o, p, q, and r in formula (7)) due to the nature of the compound. The number average molecular weight of the perfluoropolyether group is the average total molecular weight of the structures represented by the respective repeating units in formula (7).

In some embodiments, the hydrolyzable silane compound having a perfluoropolyether group may be any one of the compounds represented by the following formulas (8) to (12):

$$F—(CF_2CF_2CF_2O)_s—CF_2CF_2—[CH_2CH(Si(OCH_3)_3)]_m—H \tag{8}$$

In formula (8), s represents an integer of 1 to 30, and m represents an integer of 1 to 4.

$$F—(CF_2CF_2CF_2O)_t—CF_2CF_2—CH_2O(CH_2)_3—Si(OCH_3)_3 \tag{9}$$

In formula (9), t represents an integer of 1 to 30.

$$(H_3CO)_3Si—CH_2CH_2CH_2—OCH_2CF_2—(OCF_2CF_2)_e—(OCF_2)_f—OCF_2CH_2O—CH_2CH_2CH_2—Si(OCH_3)_3 \quad (10)$$

In formula (10), e and f each represents an integer of 1 to 30.

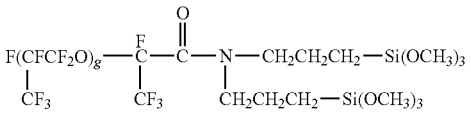

(11)

In formula (11), g represents an integer of 1 to 30.

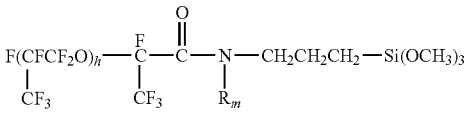

(12)

In formula (12), $R_m$ represents a methyl group or a hydrogen atom, and h represents an integer of 1 to 30.

Beneficially, the numbers s, t, e, f, g, and h of repetitions of the respective repeating units in formulas (8) to (12) are each an integer of 3 to 20. When the number of repetitions of each repeating unit is 3 or more, the liquid repellency of the compound tents to increase; and when the number of repetitions is 30 or less, the solubility of the compound in a solvent tends to increase. If a condensation reaction is made in a non-fluorine-based solvent, such as an alcohol, it is beneficial that the numbers s, t, e, f, g, and h of repetitions of the respective repeating units are each in the range of 3 to 10.

The silane compound having a perfluoropolyether group is commercially available, and examples thereof include Optool DSX and Optool AES, each produced by Daikin Industries; KY-108 and KY-164, each produced by Shin-Etsu Chemical; Novec EGC-1720 produced by 3M; and Fluorolink S10 produced by Solvay.

The condensate of the hydrolyzable silane compound having a fluorine-containing group may be a condensate of the hydrolyzable silane compound having a fluorine-containing group and a hydrolyzable silane compound having a cationically polymerizable group from the viewpoint of the degree of coverage with the liquid-repellent layer 7 and the adhesion of the liquid-repellent layer 7 to the underlying ejection opening member 4.

The cationically polymerizable group of the hydrolyzable silane compound having a cationically polymerizable group may be an epoxy group or an oxetane group. From the viewpoint of availability and reaction control, the cationically polymerizable group may be an epoxy group. The hydrolyzable silane compound having a cationically polymerizable group may be represented by the following formula (13):

$$R_C—SiX_bY_{(3-b)} \quad (13)$$

In formula (13), $R_C$ represents a nonhydrolyzable substituent having an epoxy group, R represents a nonhydrolyzable substituent, Y represents a nonhydrolyzable substituent, X represents a hydrolyzable substituent, and b represents an integer of 1 to 3.

In an embodiment, a in formula (13) may be 2 or 3, for example 3.

Examples of the nonhydrolyzable substituent represented by $R_C$ include a glycidyl group, glycidyloxyalkyl groups in which the alkyl group has a carbon number of 1 to 20, such as γ-glycidoxypropyl, and epoxycycloalkyl groups, such as 2-(3,4-epoxycyclohexyl)ethyl. The hydrolyzable substituent represented by X and the nonhydrolyzable substituent represented by Y in formula (13) are each the same as those described in formula (1). In an embodiment, X in formula (13) may be an alkoxy group. Alkoxy groups do not produce a radical that may inhibit the cationic polymerization reaction when hydrolyzed and, thus, the reactivity is easy to control.

The condensate of the hydrolyzable silane compound having a fluorine-containing group may be a condensate of the hydrolyzable silane compound having a fluorine-containing group, the hydrolyzable silane compound having a cationically polymerizable group, and, in addition, a hydrolyzable silane compound having an alkyl or an aryl group. Such a combined use with a hydrolyzable silane compound having an alkyl or an aryl group facilitates the control of the polarity and the crosslink density of the condensate. When a silane compound having a cationically nonpolymerizable alkyl or aryl group is used in combination, the freedom of the substituents of the perfluoropolyether group and the cationically polymerizable group increases. Consequently, the perfluoropolyether groups become likely to align at the interface with air, and the polymerization of the cationically polymerizable group and the condensation of the unreacted silanol group are facilitated. Also, the presence of a nonpolar group, such as an alkyl group or an aryl group, in the condensate suppresses the cleavage of the siloxane bond and thus increases the liquid repellency and durability of the resulting liquid-repellent layer 7.

The hydrolyzable silane compound having an alkyl or an aryl group may be represented by the following formula (14):

$$(R_d)_a—SiX_{(4-a)} \quad (14)$$

In formula (14), $R_d$ represents an alkyl group or an aryl group, and X represents a hydrolyzable substituent. Also, a represents an integer of 1 to 3.

The group represented by $R_d$ in formula (14) may be selected from the alkyl and aryl groups having a carbon number of 1 to 20 including methyl, ethyl, propyl, butyl, hexyl, phenyl, and naphthyl. More specifically, examples of the hydrolyzable silane compound represented by formula (14) include methyltrimethoxysilane, methyltriethoxysilane, methyltripropoxysilane, ethyltrimethoxysilane, ethyltriethoxysilane, ethyltripropoxysilane, propyltrimethoxysilane, propyltriethoxysilane, propyltripropoxysilane, dimethyldimethoxysilane, dimethyldiethoxysilane, phenyltrimethoxysilane, phenyltriethoxysilane, trimethylmethoxysilane, and trimethylethoxysilane.

Each type of the above-described hydrolyzable silane compounds may be used singly or in combination. The hydrolyzable silane compounds may be such that part of the hydrolyzable substituent thereof has been changed into a hydroxy group by hydrolysis or formed into the siloxane bond by dehydration condensation, in advance.

The proportions of the hydrolyzable silane compounds used may be appropriately determined according to how they will be used. The hydrolyzable silane compound having a fluorine-containing group may be used in a proportion in the range of 0.01 mol % to 10 mol % relative to the total moles (100 mol %) of the hydrolyzable silane compounds.

In an embodiment, it may be used in a proportion in the range of 0.1 mol % to 5 mol %. When the proportion is 0.01 mol % or more, the resulting liquid-repellent layer can exhibit a high liquid repellency. In contrast, when the proportion is 10 mol % or less, the hydrolyzable silane compound having a fluorine-containing group (for example, perfluoropolyether group) becomes unlikely to form aggregates and can form a uniform liquid-repellent layer 7. The hydrolyzable silane compound having a cationically polymerizable group may be used in a proportion in the range of 20 mol % to 80 mol % relative to the total moles (100 mol %) of the hydrolyzable silane compounds, from the viewpoint of forming a liquid-repellent layer 7 having a high durability and a high adhesion with the ejection opening member 4. When the hydrolyzable silane compound having a cationically polymerizable group is used in a proportion of 20 mol % or more, the resulting liquid-repellent layer 7 can be durable very much; when it is used in a proportion of 80 mol % or less, the cationically polymerizable group does not inhibit the alignment of the fluorine-containing groups and helps the liquid-repellent layer exhibit a high liquid repellency. In an embodiment, the proportion of the hydrolyzable silane compound having a cationically polymerizable group may be in the range of 30 mol % to 70 mol %.

The condensation of the hydrolyzable silane compounds is made by hydrolysis and condensation allowed to proceed by heating in a solvent in the presence of water. By appropriately controlling the temperature, the time, the concentration, the pH, and other factors of the hydrolysis/condensation reaction, a desired condensate can be obtained.

The condensate of the above-described hydrolyzable silane compounds is synthesized in a polar solvent containing oxygen, such as a hydroxy group, a carbonyl group, or an ether bond. Examples of the polar solvent include alcohols, such as methanol, ethanol, propanol, isopropanol, and butanol; ketones, such as methyl ethyl ketone and methyl isobutyl ketone; esters, such as ethyl acetate and butyl acetate; ethers, such as diglyme and tetrahydrofuran; and glycols, such as diethylene glycol. Also, from the viewpoint of maintaining the solubility of the fluorine-containing silane compound, a fluorine-containing solvent, such as hydrofluoroether (for example, HFE 7200 produced by 3M), may be used in combination. However, since water is used for the synthesis, an alcohol that can sufficiently solve water is suitable as the solvent. When the synthesis is performed in an alcohol solvent, the hydrolyzable substituents of the hydrolyzable silane compounds may be substituted by an alkoxy group by a substitution reaction with the alcohol. The reactivity of the butoxy and propoxy groups is lower than that of the ethoxy and methoxy groups. Accordingly, ethanol or methanol may be used as the solvent in view of the reactivity of the hydrolyzable silane compound. Also, the reaction system may be heated at 100° C. or less from the viewpoint of controlling the water content. Accordingly, if the reaction system is heated to reflux, an alcohol having a boiling point of 100° C. or less is suitable. From this point of view, ethanol or methanol is beneficial as the solvent. Since a higher boiling point leads to a reduced reaction time, ethanol may be more beneficial than methanol.

The proportion of the water in the reaction system may be in the range of 0.5 equivalent to 3 equivalents, for example, 0.8 equivalent to 2 equivalents, relative to the total moles of the hydrolyzable substituents of the hydrolyzable silane compounds. When water is used in a proportion of 0.5 equivalent or more, the hydrolysis and condensation reaction can proceed at an appropriate speed. Also, when water is used in a proportion of 3 equivalents or less, the hydrolyzable silane compound having a fluorine-containing group (for example, perfluoropolyether group) becomes unlikely to form aggregates.

Metal Oxide Particles

The metal oxide particles are made of at least one metal oxides selected from the group consisting of ZnO, $TiO_2$, $SnO_2$, $Al_2O_3$, $In_2O_3$, $SiO_2$, MgO, BaO, $MoO_2$, antimony-doped tin oxide (ATO), fluorine-doped tin oxide, tin-doped indium oxide (ITO), aluminum-doped zinc oxide (AZO), indium-doped zinc oxide (IZO), antimony-doped titanium oxide, and niobium-doped titanium oxide. In some embodiments, at least one selected from the group consisting of ZnO, $TiO_2$, $SnO_2$, antimony-doped tin oxide (ATO), aluminum-doped zinc oxide (AZO), indium-doped zinc oxide (IZO), antimony-doped titanium oxide, and niobium-doped titanium oxide may be used. In an embodiment, $SnO_2$ or ATO may be selected. The above-cited materials of the metal oxide particles may be used singly or in combination.

The metal oxide particles may be used in a proportion of 5 parts by mass or more, 10 parts by mass or more, or 20 parts by mass or more relative to 100 parts by mass of the fluorine-containing compound. The metal oxide particles in a proportion of 5 parts by mass or more are not likely to aggregate in the liquid-repellent layer and can impart a high antistatic property to the liquid-repellent layer. Also, the proportion of the metal oxide particles may be 150 parts by mass or less, 100 parts by mass or less, or 80 parts by mass or less relative to 100 parts by mass of the fluorine-containing compound. The metal oxide particles in a proportion of 150 parts by mass or less are not likely to inhibit the liquid-repellent component from functioning as intended, allowing the resulting liquid-repellent layer 7 to have a high liquid repellency.

The particle size of the metal oxide particles may have influences on the formation of the liquid-repellent layer 7. If the particle size of the metal oxide particles is excessively large, the metal oxide particles are likely to scatter light used for photocuring for forming the liquid-repellent layer 7 and reduce the optical transparency of the liquid-repellent layer 7. Thus, the liquid-repellent layer 7 occasionally cannot be cured sufficiently. Also, if the liquid-repellent layer 7 is subjected to patterning with light for forming the ejection openings 5, a low optical transparency of the liquid-repellent layer 7 may make precise patterning of the liquid-repellent layer 7 difficult. Accordingly, it is beneficial that the particle size of the metal oxide particles be smaller than ½ of the wavelength of irradiation light from the viewpoint of reducing light scattering. For example, if the coating film for the liquid-repellent layer is hardened by being irradiated with light having a wavelength of 365 nm, the particle size of the metal oxide particles may be 180 nm or less and is beneficially 120 nm or less or 100 nm or less. In contrast, metal oxide particles having an excessively small particle size are sometimes not sufficiently dispersed in the liquid. Accordingly, the particle size of the metal oxide particles may be 5 nm or more and is beneficially 10 nm or more or 50 nm or more. The particle size used herein refers to the volume average particle size measured by dynamic light scattering. For this measurement, Dynamic-Scattering Spectrophotometer manufactured by Otsuka Electronics or Dynamic Light-Scattering Particle Size Analyzer LB500 manufactured by Horiba may be used.

Amphiphilic Compound

The amphiphilic compound has both a hydrophilic group and a hydrophobic group in the molecule thereof. If the amphiphilic compound is mixed with the metal oxide particles in a liquid, the molecules of the amphiphilic compound are adsorbed to the metal oxide particles so as to cover each metal oxide particle in a state where the hydrophilic groups are aligned close to the surface of the metal oxide particle while the hydrophobic groups are aligned outside, thus forming core-shell particles. The core-shell particles are stable in the liquid and enable the metal oxide particles to be appropriately dispersed in the liquid compared to the case of using no amphiphilic compound.

In an embodiment, a nonionic amphiphilic compound may be used in view of the affinity with the solvent that will be described herein later, particularly with nonpolar solvent or fluorine-containing solvent. The amphiphilic compound may be a nonionic ether or ester, and examples thereof include polyoxyalkylene alkyl ethers, such as sorbitan fatty acid esters, alkyl glycosides, alkyl polyglycosides, and polyoxyethylene alkyl ethers; polyoxyalkylene aryl ethers, such as polyoxyethylene phenyl ethers; alkyl monoglyceryl ethers; and polyoxyalkylene perfluoroalkyl ethers. The amphiphilic compound may have a carbon number of 8 or more, for example, 12 or more Amphiphilic compounds having a carbon number of 8 or more can appropriately cover the metal oxide particles to form a stable core-shell structure. Also, the carbon number of the amphiphilic compound may be 30 or less, for example, 18 or less. Amphiphilic compounds having a carbon number of 30 or less are soluble in the solvent of the coating solution, which will be described herein later, and facilitate the dispersion of the metal oxide particles.

The amphiphilic compound content may be adjusted so that the solution used for forming the liquid-repellent layer can have a concentration higher than or equal to the critical micelle concentration according to the chemical structure thereof, the type and the amount of solvent used in the coating liquid, and temperature.

For mixing the amphiphilic compound and the metal oxide particles, liquid temperature may be controlled in the range of 10° C. to 40° C. When the liquid temperature is 10° C. or more, the amphiphilic compound is not likely to be crystallized, and when the liquid temperature is 40° C. or less, a stable core-shell structure can be formed. A stabilizing agent may be used in combination for forming a stable core-shell structure.

Solvent

The solvent of the solution used for forming the liquid-repellent layer may be a nonpolar solvent or a fluorine-containing solvent in view of the solubility of the fluorine-containing compound. Example of the nonpolar solvent include hexane, benzene, toluene, heptane, dioxane, and THF. The fluorine-containing solvent may be hydrofluoroether. These solvents may be used singly or in combination.

Other Ingredients

The solution used for forming the liquid-repellent layer 7 may optionally contain a photosensitive resin and/or a photopolymerization initiator. These additives can reduce energy required for hardening, increase the liquid repellency of the resulting layer, and facilitate patterning.

The photosensitive resin may be an epoxy resin. Examples of the epoxy resin include bisphenol A epoxy resin, bisphenol E epoxy resin, bisphenol F epoxy resin, novolac epoxy resin, cresol novolac epoxy resin, alicyclic epoxy resin, and other polyfunctional epoxy resins. In an embodiment, a polyfunctional alicyclic epoxy resin may be used. The epoxy resin is commercially available, and examples thereof include 157S70 and jER1031S (each produced by Mitsubishi Chemical); EPICLON N-695 and EPICLON N-865 (each produced by DIC Corporation); Celloxide 2021, GT-300 series, GT-400 series, and EHPE 3150 (each produced by Daicel); SU 8 (produced by Nippon Kayaku); VG 3101 and EPDX-MKR 1710 (each produced by Printec); and Denacol series (produced by Nagase Chemtex).

The photopolymerization initiator used for hardening the epoxy resin may be a compound capable of generating an acid by irradiation with light. For example, such a compound may be, but is not limited to, an aromatic sulfonium salt or an aromatic iodonium salts. Examples of the aromatic sulfonium salt include TPS-102, TPS-103, TPS-105, MDS-103, MDS-105, MDS-205, MDS-305, DTS-102, and DTS-103, each available from Midori Kagaku. SP-170 and SP-172 available from Adeka may also be used. Examples of the aromatic iodonium salt include DPI-105, MPI-103, MPI-105, BBI-101, BBI-102, BBI-103, and BBI-105, each available from Midori Kagaku.

Method for Manufacturing Recording Head

The method for manufacturing the recording head according to an embodiment will now be described with reference to FIGS. 2A to 2H.

FIGS. 2A to 2H are schematic sectional views illustrating the process steps of the method for manufacturing a recording head according to an embodiment of the present disclosure, and each cross section of the figures corresponds to the cross section shown in FIG. 1B.

Figure 2A:
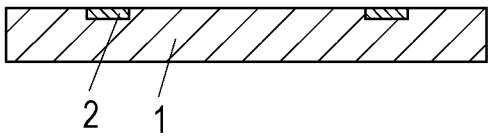
FIGS. 2A to 2H are sectional views illustrating a method for manufacturing a liquid ejection head according to an embodiment of the present disclosure.

First, a substrate 1 provided with energy generating elements 2 on the surface thereof is prepared as shown in FIG. 2A. A control signal input electrode (not shown) is connected to the energy generating elements 2 for operating the energy generating elements 2. The substrate 1 may be further provided with a protective layer (not shown) intended to enhance the durability of the energy generating elements 2, an adhesion enhancing layer (not shown) intended to enhance the adhesion between the ejection opening member 4 and the substrate 1, and any other function layer.

Figure 2B:
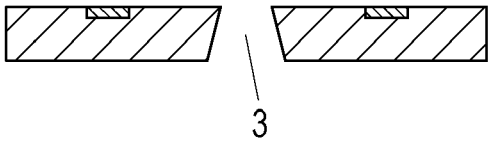

Subsequently, a supply port 3 passing through the substrate 1 is formed as shown in FIG. 2B. More specifically, the supply port 3 is formed by wet etching using an alkaline etchant, such as tetramethylammonium hydroxide (TMAH), or dry etching, such as reactive ion etching.

Figure 2C:
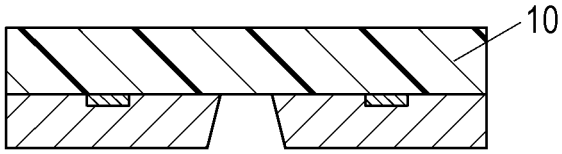

Subsequently, a first photosensitive resin layer 10 containing a photosensitive resin and a photopolymerization initiator is formed over the surface of the substrate 1 having the energy generating elements 2, as shown in FIG. 2C. The first photosensitive resin layer 10 is a negative photosensitive resin layer. For forming the first photosensitive resin layer 10, a photosensitive resin composition may be applied onto a PET or polyimide film base and then transferred to the substrate 1. An epoxy resin may be used as the photosensitive resin contained in the first photosensitive resin layer 10 in view of high mechanical strength, adhesion to the underlying layer, resistance to ink, definition of precise patterning for forming ejection openings 5, and other properties.

The epoxy resin and the photopolymerization initiator may be selected from those cited above.

The photopolymerization initiator content may be adjusted so that a desired sensitivity can be obtained. For example, the photopolymerization initiator may be added in a proportion in the range of 0.5% by weight to 5% by weight relative to the epoxy resin. The photosensitive resin composition may optionally contain a wavelength sensitizer, such as SP-100 available from Adeka.

The photosensitive resin composition may further contain one or more additives as needed. For example, a flexibility imparting agent may be added to reduce the elastic modulus of the epoxy resin, or a silane coupling agent may be added to enhance the adhesion of the resulting layer to the underlying layer.

Figure 2D:
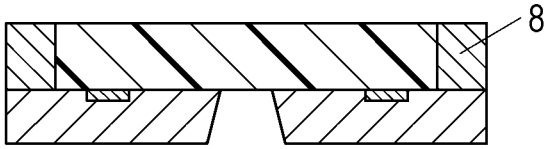

Next, as shown in FIG. 2D, the first photosensitive resin layer 10 is exposed to light with a mask (not shown) for patterning to form a side wall 8, followed by heat treatment. The mask is a plate made of a material capable of transmitting exposure light, such as glass or quartz, and provided with a light-shield film, such as a chrome film, having a pattern corresponding to the flow channels 6. The exposure apparatus may be a type including a single wavelength light source, such as i-line exposure stepper or a KrF stepper, or a projection exposure apparatus such as a Mask Aligner MPA-600 Super (manufactured by Canon) including a light source having a broad wavelength range of a mercury lamp.

Figure 2E:
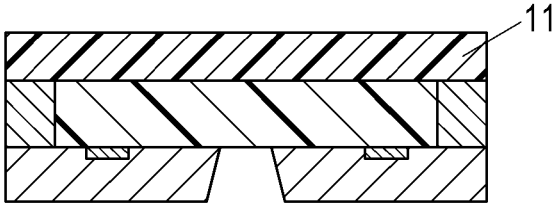

A second photosensitive resin layer 11 is formed over the substrate 1 having the side wall 8, as shown in FIG. 2E. The second photosensitive resin layer 11 is a negative photosensitive resin layer similar to the first photosensitive resin layer 10. The photosensitive resin contained in the first photosensitive resin layer 11 may be bisphenol epoxy resin or novolac epoxy resin. The second photosensitive resin layer 11 may be formed in the same manner as the first photosensitive resin layer 10.

Figure 2F:
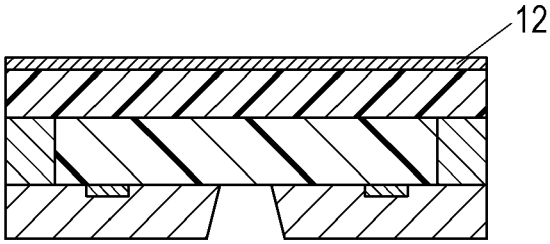

Subsequently, a coating film 12 of a solution that will be formed into the liquid-repellent layer 7 is formed over the second photosensitive resin layer 11, as shown in FIG. 2F. The coating film 12 is formed by applying a solution containing the above-described ingredients including the fluorine-containing compound, the metal oxide particles, the amphiphilic compound, and the solvent by spin coating, roll coating, slit coating, or the like.

Figure 2G:
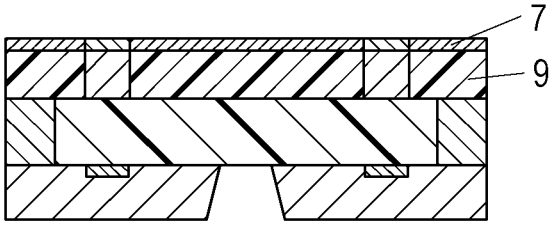

Subsequently, the second photosensitive resin layer 11 and the coating film 12 are exposed to light with a mask (not shown) for hardening and patterning to form a top plate 9 and a liquid-repellent layer 7, as shown in FIG. 2G. The mask is a plate made of a material capable of transmitting exposure light, such as glass or quartz, and provided with a light-shield film, such as a chrome film, having a pattern corresponding to the ejection openings 5. The exposure apparatus may be a type including a single wavelength light source, such as i-line exposure stepper or a KrF stepper, or a projection exposure apparatus such as a Mask Aligner MPA-600 Super (manufactured by Canon) including a light source having a broad wavelength range of a mercury lamp.

Figure 2H:
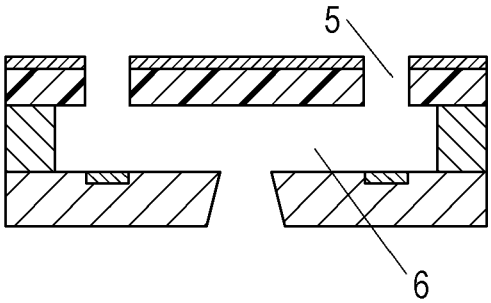

Subsequently, the unexposed portions of the second photosensitive resin layer 11 and the coating film 12 are removed by development to form ejection openings 5, as shown in FIG. 2H. The simultaneous exposure and development of the second photosensitive resin layer 11 and the coating film 12 facilitates the reaction of the cationically polymerizable groups in both layers and helps the formation of a durable, antistatic liquid-repellent layer 7. In this step, the unexposed portions of the first photosensitive resin layer 10 are also removed to form the flow channels 6.

The resulting structure is further subjected to optional heat treatment, connection to a member configured for use to supply ink (not shown), and electrical connection (not shown) for driving the energy generating elements 2 to complete the recording head.

Recording Method

The recording method according to an embodiment of the present disclosure includes ejecting a liquid onto a recording medium by using the recording head to record an image on the recording medium. The liquid contains a pigment dispersed therein with a charged dispersant or resin, or contains a self-dispersible pigment having a surface to which a charged chemical group is bound directly or with an atomic group therebetween.

The recording head can be used for ejecting a variety of liquids and is suitable for use to form an image on a recording medium with an ink (liquid) containing a pigment. In many of the inks containing a pigment, the pigment particles are stabilized in a liquid by electrostatic repulsion. In such inks, the pigment may be dispersed with a charged dispersant or resin, or may be a self-dispersible pigment having a surface to which a charged chemical group is bound directly or with an atomic group therebetween. Such a pigment ink is charged and is therefore likely to adhere to the liquid-repellent layer 7 due to a local distribution of positive charges at the surface of the liquid-repellent layer 7. The liquid-repellent layer 7 of the recording head according to an embodiment of the present disclosure maintains an antistatic property over a long period, thus suppressing the adhesion of ink to the liquid-repellent layer 7, even when a pigment ink is used.

EXAMPLES

The subject matter of the present disclosure will be further described in detail with reference to the following Examples. In the following description, the term "liquid-repellent material" refers to the entirety of the ingredients, including the solvent, used for synthesizing the fluorine-containing compound.

Synthesis of Liquid-Repellent Material

Liquid-repellent materials (i) to (iii) containing a condensate of a hydrolyzable silane compound having a fluorine-containing group were prepared according to the following procedure.

Synthesis Example 1

Liquid-repellent material (i) containing a condensate of hydrolyzable silane compounds was prepared as described below. A flask equipped with a cooling tube was charged with 27.84 g (0.1000 mol) of γ-glycidoxypropyltriethoxysilane, 17.83 g (0.1000 mol) of methyltriethoxysilane, 3.35 g (0.0047 mol) of perfluorodecylethyltriethoxysilane, 16.58 g of water, and 30.05 g of ethanol, followed by stirring at room temperature for 5 minutes. Then, the mixture was refluxed for 24 hours to yield liquid-repellent material (i). The theoretical content of the liquid-repellent component in this instance was 28% with the assumption that all the hydrolyzable groups of the hydrolyzable silane compounds were hydrolyzed and condensed.

Synthesis Example 2

Liquid-repellent material (ii) containing a condensate of hydrolyzable silane compounds was prepared as described below. The mixture of 13.81 g (0.0496 mol) of γ-glycidoxypropyltriethoxysilane, 4.42 g (0.0248 mol) of methyltriethoxysilane, 5.96 g (0.0248 mol) of phenyltrimethoxysilane, 1.05 g (0.0008 mol) of the compound represented by the following formula (15), 6.54 g of water, 19.06 g of ethanol, and 4.22 g of hydrofluoroether was stirring at room temperature for 5 minutes and was then heated to reflux for 33 hours to yield liquid-repellent material (ii). The theoretical content of the liquid-repellent component in this instance was 28% with the assumption that all the hydrolyzable groups of the hydrolyzable silane compounds were hydrolyzed and condensed.

(15)

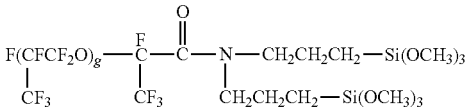

In formula (15), g represents an integer of 4 to 6.

Synthesis Example 3

Liquid-repellent material (iii) containing a condensate of hydrolyzable silane compounds was prepared by mixing the ingredients shown in the following Table 1. The value represented by mass parts of the liquid-repellent material shown in Table 1 was the value of only the condensate of the fluorine-containing compound, that is, the value of the rest of the liquid-repellent material (ii) synthesized in Synthesis Example 2 after removing the solvent

TABLE 1

| | | |
|---|---|---|
| Epoxy resin | Trade code: 157S70, Mitsubishi Chemical | 100 mass parts |
| Photopolymerization initiator | Trade code: CPI-410, San-Apro | 0.3 mass part |
| Liquid-repellent material (ii) prepared in Synthesis Example 2 | | 100 mass parts |

Preparation of Solution for Forming Liquid-Repellent Layer

A solution used for forming the liquid-repellent layer 7 was prepared according to the following procedure, using any of the liquid-repellent materials synthesized above.

Preparation Example 1

Solution (A) was prepared as described below. With 100 parts by mass of liquid-repellent material (i) from which the solvent was removed were mixed 10 parts by mass of $SnO_2$ particles having an average particle size of 50 nm as the metal oxide particles and 1000 parts of dioxane as the solvent. The mixture was stirred at room temperature for 5 minutes. Then, the compound as the amphiphilic compound represented by the following formula (16) was added in a proportion of 100 parts by mass relative to 100 parts by mass of liquid-repellent material (i) from which the solvent was removed. The resulting mixture was stirred at room temperature for 1 hour so that the metal oxide particles were coated with the amphiphilic compound.

(16)

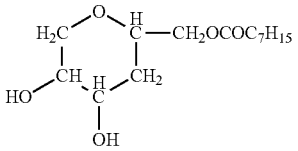

Preparation Example 2

Solution (B) was prepared in the same manner as in Preparation Example 1, except that $SnO_2$ particles having an average particle size of 50 nm as the metal oxide particles were used in a proportion of 20 parts by mass relative to 100 parts by mass of liquid-repellent material (i) from which the solvent was removed.

Preparation Example 3

Solution (C) was prepared in the same manner as in Preparation Example 1, except that $SnO_2$ particles having an average particle size of 50 nm as the metal oxide particles were used in a proportion of 80 parts by mass relative to 100 parts by mass of liquid-repellent material (i) from which the solvent was removed.

Preparation Example 4

Solution (D) was prepared in the same manner as in Preparation Example 1, except that $SnO_2$ particles having an average particle size of 50 nm as the metal oxide particles were used in a proportion of 100 parts by mass relative to 100 parts by mass of liquid-repellent material (i) from which the solvent was removed.

Preparation Example 5

Solution (E) was prepared in the same manner as in Preparation Example 1, except that $SnO_2$ particles having an average particle size of 50 nm as the metal oxide particles were used in a proportion of 5 parts by mass relative to 100 parts by mass of liquid-repellent material (i) from which the solvent was removed.

Preparation Example 6

Solution (F) was prepared in the same manner as in Preparation Example 1, except that $SnO_2$ particles having an average particle size of 50 nm as the metal oxide particles were used in a proportion of 120 parts by mass relative to 100 parts by mass of liquid-repellent material (i) from which the solvent was removed.

Preparation Example 7

Solution (G) was prepared in the same manner as in Preparation Example 1, except that $SnO_2$ particles having an average particle size of 10 nm as the metal oxide particles were used in a proportion of 50 parts by mass relative to 100 parts by mass of liquid-repellent material (i) from which the solvent was removed.

Preparation Example 8

Solution (H) was prepared in the same manner as in Preparation Example 1, except that $SnO_2$ particles having an average particle size of 100 nm as the metal oxide particles were used in a proportion of 50 parts by mass relative to 100 parts by mass of liquid-repellent material (i) from which the solvent was removed.

Preparation Example 9

Solution (I) was prepared in the same manner as in Preparation Example 1, except that $SnO_2$ particles having an average particle size of 5 nm as the metal oxide particles were used in a proportion of 50 parts by mass relative to 100 parts by mass of liquid-repellent material (i) from which the solvent was removed.

Preparation Example 10

Solution (J) was prepared in the same manner as in Preparation Example 1, except that $SnO_2$ particles having an average particle size of 120 nm as the metal oxide particles were used in a proportion of 50 parts by mass relative to 100 parts by mass of liquid-repellent material (i) from which the solvent was removed.

Preparation Example 11

Solution (K) was prepared as described below. With 100 parts by mass of liquid-repellent material (ii) from which the solvent was removed were mixed 50 parts by mass of $SnO_2$ particles having an average particle size of 50 nm as the metal oxide particles and 1000 parts of dioxane as the solvent. The mixture was stirred at room temperature for 5 minutes. Then, the compound represented by the following formula (16) was added in a proportion of 100 parts by mass relative to 100 parts by mass of liquid-repellent material (ii) from which the solvent was removed. The resulting mixture was stirred at room temperature for 1 hour to yield solution (K).

Preparation Example 12

Solution (L) was prepared as described below. With 100 parts by mass of liquid-repellent material (iii) from which the solvent was removed were mixed 20 parts by mass of $SnO_2$ particles having an average particle size of 50 nm as the metal oxide particles and 1000 parts of dioxane as the solvent. The mixture was stirred at room temperature for 5 minutes. Then, the compound represented by the following formula (16) was added in a proportion of 100 parts by mass relative to 100 parts by mass of liquid-repellent material (iii) from which the solvent was removed. The resulting mixture was stirred at room temperature for 1 hour to yield solution (L).

Preparation Example 13

Solution (M) was prepared in the same manner as in Preparation Example 2 except for using hydrofluoroether HFE 7200 (produced by 3M) as the solvent. Preparation Example 14

Solution (N) was prepared in the same manner as in Preparation Example 2 except for using the compound represented by the following formula (17) as the amphiphilic compound.

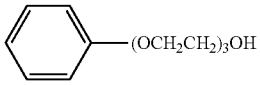

(17)

Preparation Example 15

Solution (O) was prepared in the same manner as in Preparation Example 2 except for using the compound represented by the following formula (18) as the amphiphilic compound.

$$C_6F_{13}—C_2H_4(OCH_2CH_2)_5OH \quad (18)$$

Preparation Example 16

Solution (P) was prepared in the same manner as in Preparation Example 2 except for using the compound represented by the following formula (19) as the amphiphilic compound.

$$C_4H_9—(OCH_2CH_2)_3OH \quad (19)$$

Preparation Example 17

Solution (Q) was prepared in the same manner as in Preparation Example 2 except for using the compound represented by the following formula (20) as the amphiphilic compound.

$$C_4H_9—(OCH_2CH_2)_{10}OH \quad (20)$$

Preparation Example 18

Solution (R) was prepared in the same manner as in Preparation Example 2, except that ATO particles having an average particle size of 50 nm as the metal oxide particles were used in a proportion of 20 parts by mass relative to 100 parts by mass of liquid-repellent material (i) from which the solvent was removed.

Comparative Preparation Example 1

Solution (a) was prepared as described below. With 100 parts by mass of liquid-repellent material (i) from which the solvent was removed were mixed 50 parts by mass of $LiBF_4$ particles having an average particle size of 50 nm as the metal oxide particles and 1000 parts of dioxane as the solvent. The mixture was stirred at room temperature for 5 minutes to yield solution (a).

Comparative Preparation Example 2

Solution (b) was prepared in the same manner as in Comparative Preparation Example 1 except for using $LiBF_4$ particles having an average particle size of 50 nm in a proportion of 120 parts by mass relative to 100 parts by mass of liquid-repellent material (i) from which the solvent was removed.

Comparative Preparation Example 3

Solution (c) was prepared in the same manner as in Comparative Preparation Example 1 except for using $LiBF_4$ particles having an average particle size of 50 nm in a proportion of 200 parts by mass relative to 100 parts by mass of liquid-repellent material (i) from which the solvent was removed.

Comparative Preparation Example 4

Solution (d) was prepared in the same manner as in Comparative Preparation Example 1, except that $SnO_2$ particles having an average particle size of 50 nm were used, instead of $LiBF_4$ particles having an average particle size of 50 nm, in a proportion of 50 parts by mass relative to 100 parts by mass of liquid-repellent material (i) from which the solvent was removed.

Comparative Preparation Example 5

Solution (e) was prepared in the same manner as in Comparative Preparation Example 4 except for using $SnO_2$ particles having an average particle size of 50 nm in a proportion of 200 parts by mass relative to 100 parts by mass of liquid-repellent material (i) from which the solvent was removed.

Comparative Preparation Example 6

With 100 parts by mass of liquid-repellent material (i) from which the solvent was removed, 1000 parts of dioxane was mixed as the solvent. The mixture was stirred at room temperature for 5 minutes to yield solution (f).

Formation Liquid-Repellent Layer

Example 1

A simple structure including an ejection opening member 4 and a liquid-repellent layer 7 was formed according to the following procedure. First, an epoxy resin composition containing the ingredients shown in Table 2 was applied onto a silicon substrate to form a photosensitive resin layer. The photosensitive resin layer was to be formed into the ejection opening member 4.

TABLE 2

| | | |
|---|---|---|
| Epoxy resin | Trade code: EHPE-3150, Daicel | 100 mass parts |
| Photopolymerization initiator | Trade name: Adeka Optomer SP-172, Adeca | 6 mass parts |
| Solvent | Xylene, Kishida Chemical | 70 mass parts |

Solution (A) prepared in Preparation Example 1 was applied onto the photosensitive resin layer, and the coating film was heated at 70° C. for 3 minutes. The coating film was to be formed into the liquid-repellent layer 7.

Subsequently, the photosensitive resin layer and the coating film were exposed together to light for patterning with a mask having a pattern corresponding to the ejection openings 5. For this exposure, an i-line exposure stepper (manufactured by Canon) was used as the exposure device. The exposure dose was set to 4500 J/m$^2$. Then, the exposed portions were hardened by being heated.

Then, the unexposed portions of the photosensitive resin layer and the coating film were removed by being dissolved in propylene glycol monomethyl ether acetate (PGMEA), thus forming the ejection opening member 4, ejection openings 5, and the liquid-repellent layer 7.

Examples 2 to 11 and 13 to 18

The ejection opening member 4, the ejection openings 5, and the liquid-repellent layer 7 were formed in the same manner as in Example 1, except that the liquid-repellent layer 7 was formed by respectively using solutions (B) to (K) and (M) to (R) prepared in Preparation Examples 2 to 11 and 13 to 18.

Example 12

The ejection opening member 4, the ejection openings 5, and the liquid-repellent layer 7 were formed in the same manner as in Example 1 except that the epoxy resin composition containing the ingredients shown in the following Table 3 was used for forming the photosensitive resin layer, and that solution (L) prepared in Preparation Example 12 was used for forming the liquid-repellent layer 7.

TABLE 3

| | | |
|---|---|---|
| Epoxy resin | Trade code: 157S70, Mitsubishi Chemical | 100 mass parts |
| Photopolymerization initiator | Trade code: CPI-410, San-Apro | 0.01 mass part |
| Solvent | PGMEA, Kishida Chemical | 20 mass parts |

Comparative Examples 1 to 6

The ejection opening member 4, the ejection openings 5, and the liquid-repellent layer 7 were formed in the same manner as in Example 1, except that the liquid-repellent layer 7 was formed by respectively using solutions (a) to (f) prepared in Comparative Preparation Examples 1 to 6.

Evaluation of Liquid-Repellent Layer

The liquid-repellent layers formed in Examples 1 to 18 and Comparative Examples 1 to 6 were examined as described below for evaluation. First, each liquid-repellent layer was subjected to wiping with an HNBR (hydrogenated nitrile rubber) blade while a pigment ink was being sprayed to the surface of the liquid-repellent layer, and whether the ink had adhered to the surface of the liquid-repellent layer was checked visually and under an optical microscope after 5000 wiping operations and 10000 wiping operations. The antistatic property of the liquid-repellent layer was grated based on the observation results according to the following criteria.

Criteria of Antistatic Property:

A: No adhesion of ink was observed in either visual observation or microscopic observation.

B: Adhesion of ink was not observed in visual observation, but was observed in microscopic observation.

C: Adhesion of ink was partially observed in visual observation.

D: Adhesion of ink was observed over the entire surface in visual observation.

Also, the dynamic receding contact angle θr of pure water on the liquid-repellent layer was measured with a small contact angle meter DropMeasure manufactured by Microjet, and the liquid repellency was graded according to following criteria.

Criteria of Liquid Repellency

A: 95° or more

B: 80° or more and less than 95°

C: 70° or more and less than 80°

D: 70° or less

The results are shown in the following Table 4.

TABLE 4

| | | Antistatic agent | | | | | | | | Antistatic property Number of wiping operations | | | Liquid repellency Number of wiping operations | | |
|---|---|---|---|---|---|---|---|---|---|---|---|---|---|---|---|
| | Solvent | Metal oxide particles (core) | amphiphilic compound (shell) Compound | Carbon number | Proportion [parts] | Average particle size [nm] | Liquid-repellent material | Coating solvent | Photosensitive resin | 1000 | 5000 | 10000 | 1000 | 5000 | 10000 |
| Example 1 | A | $SnO_2$ | Formula (16) | 12 | 10 | 50 | (i) | Dioxane | Table 2 | A | A | B | A | A | A |
| Example 2 | B | $SnO_2$ | Formula (16) | 12 | 20 | 50 | (i) | Dioxane | Table 2 | A | A | A | A | A | A |
| Example 3 | C | $SnO_2$ | Formula (16) | 12 | 80 | 50 | (i) | Dioxane | Table 2 | A | A | A | A | A | A |
| Example 4 | D | $SnO_2$ | Formula (16) | 12 | 100 | 50 | (i) | Dioxane | Table 2 | A | A | A | A | A | B |
| Example 5 | E | $SnO_2$ | Formula (16) | 12 | 5 | 50 | (i) | Dioxane | Table 2 | A | B | B | A | A | A |

TABLE 4-continued

| | Antistatic agent | | | | | | Liquid-repellent material | | | Antistatic property Number of wiping operations | | | Liquid repellency Number of wiping operations | | |
|---|---|---|---|---|---|---|---|---|---|---|---|---|---|---|---|
| | Solvent | Metal oxide particles (core) | amphiphilic compound (shell) Compound | Carbon number | Proportion [parts] | Average particle size [nm] | | Coating solvent | Photosensitive resin | 1000 | 5000 | 10000 | 1000 | 5000 | 10000 |
| Example 6 | F | $SnO_2$ | Formula (16) | 12 | 120 | 50 | (i) | Dioxane | Table 2 | A | A | A | A | B | B |
| Example 7 | G | $SnO_2$ | Formula (16) | 12 | 50 | 10 | (i) | Dioxane | Table 2 | A | A | A | A | A | A |
| Example 8 | H | $SnO_2$ | Formula (16) | 12 | 50 | 100 | (i) | Dioxane | Table 2 | A | A | A | A | A | A |
| Example 9 | I | $SnO_2$ | Formula (16) | 12 | 50 | 5 | (i) | Dioxane | Table 2 | A | B | B | A | A | A |
| Example 10 | J | $SnO_2$ | Formula (16) | 12 | 50 | 120 | (i) | Dioxane | Table 2 | A | A | A | A | B | B |
| Example 11 | K | $SnO_2$ | Formula (16) | 12 | 50 | 50 | (ii) | Dioxane | Table 2 | A | A | A | A | A | A |
| Example 12 | L | $SnO_2$ | Formula (16) | 12 | 20 | 50 | (iii) | Dioxane | Table 3 | A | A | A | A | A | A |
| Example 13 | M | $SnO_2$ | Formula (16) | 12 | 20 | 50 | (i) | HFE7200 | Table 2 | A | A | A | A | A | A |
| Example 14 | N | $SnO_2$ | Formula (17) | 12 | 20 | 50 | (i) | Dioxane | Table 2 | A | A | A | A | A | A |
| Example 15 | O | $SnO_2$ | Formula (18) | 18 | 20 | 50 | (i) | Dioxane | Table 2 | A | A | A | A | A | A |
| Example 16 | P | $SnO_2$ | Formula (19) | 10 | 20 | 50 | (i) | Dioxane | Table 2 | A | B | B | A | A | A |
| Example 17 | Q | $SnO_2$ | Formula (20) | 24 | 20 | 50 | (i) | Dioxane | Table 2 | A | B | B | A | A | A |
| Example 18 | R | ATO | Formula (16) | 12 | 20 | 50 | (i) | Dioxane | Table 2 | A | A | A | A | A | A |
| Comparative Example 1 | a | $LiBF_4$ | — | — | 50 | 50 | (i) | Dioxane | Table 2 | A | C | D | B | B | B |
| Comparative Example 2 | b | $LiBF_4$ | — | — | 120 | 50 | (i) | Dioxane | Table 2 | A | C | C | B | D | D |
| Comparative Example 3 | c | $LiBF_4$ | — | — | 200 | 50 | (i) | Dioxane | Table 2 | A | B | B | D | D | D |
| Comparative Example 4 | d | $SnO_2$ | — | — | 50 | 50 | (i) | Dioxane | Table 2 | A | C | D | B | B | B |
| Comparative Example 5 | e | $SnO_2$ | — | — | 200 | 50 | (i) | Dioxane | Table 2 | A | C | C | B | D | D |
| Comparative Example 6 | f | — | — | — | -— | | (i) | Dioxane | Table 2 | A | C | D | B | B | B |

Table 4 shows that Examples 1 to 18 exhibited good results in antistatic property and liquid repellency. In particular, Examples 2, 3, 7, 8, 11 to 15, and 18 using an amphiphilic compound having a carbon number in the range of 12 to 18 and metal oxide particles having an average particle size in the range of 10 nm to 100 nm in a proportion in the range of 20 parts by mass to 80 parts by mass were superior in both antistatic property and liquid repellency.

On the other hand, in Comparative Example 1 using an alkali metal salt as the antistatic agent, the antistatic property decreased as the number of times of wiping increased. In Comparative Examples 2 and 3 using a larger amount of antistatic agent than in Comparative Example 1, adhesion of ink was reduced, and the liquid repellency was reduced. Also, in the case of using metal oxide particles alone as the antistatic agent without combination with any amphiphilic compound, when the amount of metal oxide particles was small as in Comparative Example 4, the dispersion of the metal oxide particles was not stable and caused ink to adhere to the liquid-repellent layer, and when the amount of the metal particles was increased as in Comparative Example 5, liquid repellency was reduced. In Comparative Example 6 not using any antistatic agent, a certain level of liquid repellency was exhibited, but ink adhered to the liquid-repellent layer with increasing times of wiping.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-193782 filed Oct. 3, 2017, which is hereby incorporated by reference herein in its entirety.

What is claimed is:

1. A liquid ejection head, comprising:

an ejection opening member having an ejection opening therein through which a liquid is ejected; and a liquid-repellent layer over the ejection opening member, the liquid-repellent layer containing a fluorine-containing compound, metal oxide particles, and an amphiphilic compound, wherein the fluorine-containing compound is a condensate of a hydrolyzable silane compound having a fluorine-containing group, and wherein the hydrolyzable silane compound is at least one member selected from the group consisting of compounds represented by the following formulas (1) to (5):

$$R_f—SiX_aY_{(3-a)} \quad (1)$$

wherein in formula (1), $R_f$ represents a nonhydrolyzable substituent having a perfluoroalkyl group, Y represents a nonhydrolyzable substituent, X represents a hydrolyzable substituent, and a represents an integer of 1 to 3, $$F—R_p—A—SiX_aY_{3-a} \quad (2)$$

$$R_{3-a}X_aSi—A—R_p—A—SiX_aY_{3-a} \quad (3)$$

$$F—R_p—Q—[A(SiX_aY_{3-a})]_m—Z \quad (4)$$

$$F—R_p—Q—[A—SiX_aY_{3-a}]_n \quad (5)$$

wherein in formulas (2) to (5), $R_p$ represents a perfluoropolyether group, A represents a linking group having a carbon number of 1 to 12, X represents a hydrolyzable substituent, Y and R each represent a nonhydrolyzable substituent, Z represents a hydrogen atom or an alkyl group, Q represents a divalent or trivalent linking member, n represents 1 when Q is a trivalent linking member, or 2 when Q is a trivalent linking member, a represents an integer of 1 to 3, and m represents an integer of 1 to 4.

2. The liquid ejection head according to claim 1, wherein a in formulas (1) to (5) is 3.

3. The liquid ejection head according to claim 1, wherein the metal oxide particles are made of at least one metal oxide selected from the group consisting of ZnO, $TiO_2$, $SnO_2$, $Al_2O_3$, $In_2O_3$, $SiO_2$, MgO, BaO, $MoO_2$, antimony-doped tin oxide, fluorine-doped tin oxide, tin-doped indium oxide, aluminum-doped zinc oxide, indium-doped zinc oxide, antimony-doped titanium oxide, and niobium-doped titanium oxide.

4. The liquid ejection head according to claim 1, wherein the metal oxide particles are particles of one of $SnO_2$ and antimony-doped tin oxide.

5. The liquid ejection head according to claim 1, wherein the proportion of the metal oxide particles is 5 parts by mass to 150 parts by mass relative to 100 parts by mass of the fluorine-containing compound.

6. The liquid ejection head according to claim 1, wherein the metal oxide particles have a particle size of 5 nm to 180 nm.

7. The liquid ejection head according to claim 1, wherein the amphiphilic compound is at least one compound selected from the group consisting of polyoxyalkylene alkyl ethers, polyoxyalkylene aryl ethers, alkyl monoglyceryl ethers, and polyoxyalkylene perfluoroalkyl ethers.

8. The liquid ejection head according to claim 1, wherein the metal oxide particles are coated with the amphiphilic compound.

9. A method for manufacturing a liquid ejection head including an ejection opening member having an ejection opening therein through which a liquid is ejected, and a liquid-repellent layer over the ejection opening member, the method comprising:

forming the liquid-repellent layer by applying a solution containing a fluorine-containing compound, metal oxide particles, an amphiphilic compound, and a solvent to form a coating film of the solution and hardening the coating film, wherein the fluorine-containing compound is a condensate of a hydrolyzable silane compound having a fluorine-containing group, and wherein the hydrolyzable silane compound is at least one member selected from the group consisting of compounds represented by the following formulas (1) to (5):

$$R_f\text{—}SiX_aY_{(3-a)} \quad (1)$$

wherein in formula (1), $R_f$ represents a nonhydrolyzable substituent having a perfluoroalkyl group, Y represents a nonhydrolyzable substituent, X represents a hydrolyzable substituent, and a represents an integer of 1 to 3, $$F\text{—}R_p\text{—}A\text{—}SiX_aY_{3-a} \quad (2)$$

$$R_{3-a}X_aSi\text{—}A\text{—}R_p\text{—}A\text{—}SiX_aY_{3-a} \quad (3)$$

$$F\text{—}R_p\text{—}Q\text{—}[A(SiX_aY_{3-a})]_m\text{—}Z \quad (4)$$

$$F\text{—}R_p\text{—}Q\text{—}[A\text{—}SiX_aY_{3-a}]_n \quad (5)$$

wherein in formulas (2) to (5), $R_p$ represents a perfluoropolyether group, A represents a linking group having a carbon number of 1 to 12, X represents a hydrolyzable substituent, Y and R each represent a nonhydrolyzable substituent, Z represents a hydrogen atom or an alkyl group, Q represents a divalent or trivalent linking member, n represents 1 when Q is a trivalent linking member, or 2 when Q is a trivalent linking member, a represents an integer of 1 to 3, and m represents an integer of 1 to 4.

10. The method according to claim 9, including:

forming a photosensitive resin layer that is to be formed into the ejection opening member;

applying the solution onto the photosensitive resin layer to form the coating film of the solution; and exposing and developing the photosensitive resin layer and the coating film to form the ejection opening.

11. The method according to claim 9, wherein a in formulas (1) to (5) is 3.

12. The method according to claim 9, wherein the metal oxide particles are made of at least one metal oxide selected from the group consisting of ZnO, $TiO_2$, $SnO_2$, $Al_2O_3$, $In_2O_3$, $SiO_2$, MgO, BaO, $MoO_2$, antimony-doped tin oxide, fluorine-doped tin oxide, tin-doped indium oxide, aluminum-doped zinc oxide, indium-doped zinc oxide, antimony-doped titanium oxide, and niobium-doped titanium oxide.

13. The method according to claim 9, wherein the metal oxide particles are particles of one of $SnO_2$ and antimony-doped tin oxide.

14. The method according to claim 9, wherein the proportion of the metal oxide particles is of 5 parts by mass to 150 parts by mass relative to 100 parts by mass of the fluorine-containing compound.

15. The method according to claim 9, wherein the metal oxide particles have a particle size of 5 nm to 180 nm.

16. The method according to claim 9, wherein the amphiphilic compound is at least one compound selected from the group consisting of polyoxyalkylene alkyl ethers, polyoxyalkylene aryl ethers, alkyl monoglyceryl ethers, and polyoxyalkylene perfluoroalkyl ethers.

17. A liquid ejection head, comprising:

an ejection opening member having an ejection opening therein through which a liquid is ejected; and a liquid-repellent layer over the ejection opening member, the liquid-repellent layer containing a fluorine-containing compound, metal oxide particles, and an amphiphilic compound, wherein the amphiphilic compound is at least one compound selected from the group consisting of polyoxyalkylene alkyl ethers, polyoxyalkylene aryl ethers, alkyl monoglyceryl ethers, and polyoxyalkylene perfluoroalkyl ethers.

* * * * *